US011067009B2

(12) United States Patent
Carlson et al.

(10) Patent No.: US 11,067,009 B2
(45) Date of Patent: Jul. 20, 2021

(54) METHOD FOR ESTIMATING CYLINDER PRESSURE

(71) Applicant: VOLVO TRUCK CORPORATION, Gothenburg (SE)

(72) Inventors: David Carlson, Mölndal (SE); Staffan Lundgren, Hindås (SE)

(73) Assignee: VOLVO TRUCK CORPORATION, Göteborg (SE)

( * ) Notice: Subject to any disclaimer, the term of this patent is extended or adjusted under 35 U.S.C. 154(b) by 0 days.

(21) Appl. No.: 16/976,974

(22) PCT Filed: Mar. 16, 2018

(86) PCT No.: PCT/EP2018/056643
§ 371 (c)(1),
(2) Date: Aug. 31, 2020

(87) PCT Pub. No.: WO2019/174740
PCT Pub. Date: Sep. 19, 2019

(65) Prior Publication Data

US 2021/0003082 A1 Jan. 7, 2021

(51) Int. Cl.
*F02D 35/02* (2006.01)
*F02D 13/02* (2006.01)
*F02D 41/00* (2006.01)

(52) U.S. Cl.
CPC ..... *F02D 35/024* (2013.01); *F02D 13/0203* (2013.01); *F02D 35/025* (2013.01);
(Continued)

(58) Field of Classification Search
CPC .... F02D 35/024; F02D 35/025; F02D 35/027; F02D 13/0203; F02D 13/0253;
(Continued)

(56) References Cited

U.S. PATENT DOCUMENTS 8,265,853 B2 9/2012 Buslepp et al.
9,239,015 B2 1/2016 Cowgill
(Continued)

FOREIGN PATENT DOCUMENTS

DE 10017560 A1 10/2001
JP 2008255932 A 10/2008
WO 2016087700 A1 6/2016

OTHER PUBLICATIONS

International Search Report and Written Opinion dated Nov. 12, 2018 in corresponding PCT Application No. PCT/EP2018/056643, 8 pages.

(Continued)

*Primary Examiner* — Hai H Huynh
(74) *Attorney, Agent, or Firm* — Venable LLP; Jeffri A Kaminski

(57) ABSTRACT

The invention relates to a method (100) for estimating a cylinder pressure (CP) in an internal combustion engine arrangement (10), the method comprising the steps of: initiating (110) an opening of a valve by an actuator during an expansion stroke; monitoring (120) the valve to determine a point in time (Tp) when the valve opens; determining (130) a differential pressure (DP) between the combustion cylinder and a position in a fluid medium exhaust passage (29, 39, 60) downstream said valve at the point in time (Tp); receiving (140) data being indicative of a pressure (EP) in the fluid medium passage at the point in time (Tp); and determining (150) the cylinder pressure (CP) at the point in time (Tp) based on the determined differential pressure (DP) and the data indicative of the pressure in said fluid medium passage.

19 Claims, 3 Drawing Sheets

(52) U.S. Cl.
CPC ..... *F02D 35/027* (2013.01); *F02D 41/009* (2013.01); *F02D 2200/023* (2013.01); *F02D 2200/024* (2013.01)

(58) Field of Classification Search
CPC ..... F02D 41/009; F02D 41/1448; F02D 2200/023; F02D 2200/024; F02D 2200/0406; F02D 2200/0414; F02D 2200/0802; F02D 2041/001; F02D 2041/002; F02D 2041/1433; F01L 9/10
USPC ..... 123/435; 701/111; 73/114.16, 114.17
See application file for complete search history.

(56) References Cited

U.S. PATENT DOCUMENTS

| | | | |
|---|---|---|---|
| 2006/0054136 | A1 | 3/2006 | Fuwa et al. |
| 2009/0055074 | A1 | 2/2009 | Ishiguro et al. |

OTHER PUBLICATIONS

International Preliminary Report on Patentability dated Feb. 28, 2020 in corresponding PCT Application No. PCT/EP2018/056643, 14 pages.

METHOD FOR ESTIMATING CYLINDER PRESSURE

CROSS-REFERENCE TO RELATED APPLICATIONS

This application is a U.S. National Stage application of PCT/EP2018/056643, filed Mar. 16, 2018, and published on Sep. 19, 2019, as WO 2019/174740 A1, all of which is hereby incorporated by reference in its entirety.

TECHNICAL FIELD

The invention relates to a method for estimating a cylinder pressure in an internal combustion engine arrangement. In particular, the invention relates to a method for estimating a cylinder pressure in an internal combustion engine arrangement of a vehicle. The invention also relates to an internal combustion engine arrangement, typically comprising a control unit for performing a method for estimating a cylinder pressure in an internal combustion engine arrangement.

The invention is applicable on various types of vehicles, in particular heavy-duty vehicles, such as trucks, buses, construction equipment, working machines e.g. wheel loaders, articulated haulers, dump trucks, excavators and backhoe loaders etc. Although the invention will mainly be described in relation to a truck, the invention is not restricted to this in particular, but may also be used in other vehicles such as cars and the like. The invention may also be applied in any other type of internal combustion engine arrangement for power generation, e.g. in an arrangement comprising an internal combustion engine and a generator for power generation.

BACKGROUND

Ordinary reciprocating internal combustion engines, e.g. diesel combustion engines, are generally configured to be operated under various types of operating conditions, e.g. at low, medium and high engine loads. Moreover, these types of internal combustion engines may not only be required to meet legislative regulations relating to environmental aspects such as exhaust gases but may also need to be optimized to meet safety regulations. In addition, there is an on-going interest in optimizing the general fuel consumption of the vehicle to improve the fuel economy.

For internal combustion diesel engines, combustion control is one possible approach for reducing not only engine exhaust emissions but also cylinder-to-cylinder variation.

As a consequence, several different strategies for controlling internal combustion engine arrangements have been suggested and developed, particularly in the field of heavy-duty vehicles, such as trucks. Many of these engine control systems are calibrated to ensure a safe peak cylinder pressure level, while the engine is operated in a test environments, such as in a test cell. During this type of simulation or test, the cylinder pressure traces are monitored.

The pressure in the cylinder is typically monitored by one or several cylinder pressure sensors arranged in fluid communication with an individual cylinder. However, the high cost and frequent calibrations of pressure sensors and the overall engine design often present difficulties for manufacturers.

Conventionally, a combustion cylinder of an internal combustion engine comprises an inlet valve and an outlet valve, wherein the inlet valve is arranged in an open position at an intake phase during the downward motion of a piston in the combustion cylinder. The inlet valve is thereafter closed when the piston reaches the bottom dead center (BDC) of the cylinder, and is closed during the compression phase, the combustion phase and the exhaust phase, and opened again when the piston reaches the top dead center (TDC) for the next coming intake stroke.

However, the operational conditions of operating the engine in a vehicle in ordinary use are difficult to reflect in a simulation or in a test environment. This means that the internal combustion engine settings often are set with a wide safety margin to accommodate for any deviations resulting from different ambient conditions during ordinary use of the engine. Further, heavy-duty engines are typically subjected to various types of demanding durability requirements.

US 20060054136 A1 discloses one example of a device for controlling an internal combustion engine based on a pressure in the cylinder. This type of device comprises a variable valve mechanism for varying opening areas of at least either the intake valves or the exhaust valves. In particular, a pressure in the cylinder is calculated based on the opening area of the intake valve or the exhaust valve varied by the variable valve mechanism. The internal combustion engine is controlled based on the pressure in the cylinder.

Despite the activity in the field, there remains a need for an improved method of estimating cylinder pressure in an internal combustion engine arrangement.

SUMMARY

An object of the invention is to provide a more simple method of estimating cylinder pressure in an internal combustion engine arrangement, such as a diesel internal combustion engine, which is capable of being performed during ordinary operation of the engine arrangement in a vehicle. The object is at least partly achieved by a method according to claim 1.

According to a first aspect of the present invention, there is provided a method for estimating a cylinder pressure in an internal combustion engine arrangement. The internal combustion engine arrangement comprises an internal combustion engine, which has a combustion cylinder and a reciprocating piston movable within the combustion cylinder between a bottom dead center and a top dead center. The internal combustion engine arrangement further comprises a flow control valve assembly in fluid communication with the combustion cylinder. The flow control valve assembly comprises a valve operable between an open position and a closed position and an actuator operable to provide an opening force for opening the valve.

Moreover, the method comprises the steps of:

- initiating an opening of the valve by the actuator during an expansion stroke;
- monitoring the valve to determine a point in time when the valve opens;
- determining a differential pressure between the combustion cylinder and a position in a fluid medium passage downstream the valve at the point in time;
- receiving data being indicative of a pressure in the fluid medium passage at the point in time;
- determining the cylinder pressure at the point in time based on the determined differential pressure and the data indicative of the pressure in the fluid medium passage.

By the steps of the method according to the example embodiments, it becomes possible to provide a versatile and simple method of estimating cylinder pressure by detecting and using a single point in time of the differential pressure across a valve as a starting point to estimate the cylinder pressure. In other words, the invention is based on requesting an opening of a valve by operating an actuator and monitoring the behavior of the valve to identify when the valve opens. In this manner, it becomes possible to further determine the cylinder pressure at this specific point in time based on the differential pressure and the pressure in the fluid medium passage.

As such, the method is configured to utilize valve position feedback of the valve, i.e. the time point of the opening of the valve, as a means for estimating the cylinder pressure, and is thus not dependent on pressure sensors for monitoring cylinder pressure in the cylinder.

The example embodiments of the method are particularly useful for estimating cylinder pressure during ordinary operation of the engine arrangement in a vehicle. By way of example, the method according to the example embodiments can be used as an integrated part of an engine management system (EMS). Thus, the engine settings can be optimized during operation of the engine arrangement and the vehicle for any given set of operating conditions. Moreover, the method allows for maintaining the peak cylinder pressure (PCP) on a safe level, while engine performance and fuel economy can be optimized during vehicle operation. The method according to the example embodiments may even permit using a more dynamic PCP as the engine settings can be optimized during operation of the engine arrangement and the vehicle by the method. Accordingly, the method is particularly useful for being implemented in heavy-duty vehicles with heavy-duty engines that normally pose demanding durability requirements on the engine arrangements.

By providing a method allowing for estimating cylinder pressure during ordinary operation of the engine in a vehicle, the engine performance can be optimized continuously without risking excessive PCPs, thus contributing to an improved engine performance and fuel economy of the vehicle.

Further, by having at least one flow control valve assembly as mentioned above, it becomes possible to decide when the process of opening the valve should begin and also to at least partly control when the valve opens in the combustion cycle. Moreover, by using a flow control valve assembly, it becomes possible to provide an enhanced level of freedom of operation without causing negative implications on the overall design of the engine arrangement.

Thus, by using a flow control valve assembly in the steps of initiating an opening of the valve by the actuator during the expansion stroke, i.e. before the actuator force is sufficient to actually open the valve, and subsequently monitoring the valve to determine the point in time when the valve opens, it becomes possible to instantly determine the differential pressure for a given point in time.

The internal combustion engine is typically an internal combustion engine of a vehicle, such as a truck or the like. Accordingly, the example embodiments of the method are particularly applicable on an internal combustion engine arrangement of a vehicle. The example embodiments of the method may likewise be applicable on other types of internal combustion engines intended for power generation, vessel power propulsion and the like, but also in various hybrid systems including an internal combustion engine. Thus, the example embodiments may e.g. be used in various types of genset applications, including diesel generators, a combination of diesel engine and electric generator etc. Further, the example embodiments of the method may also be incorporated in other types of engine-electric generators, as well as in railway locomotives, vessels, ferries, pumps such as water pumps etc. Typically, such systems may include a diesel internal combustion engine and a generator operatively connected to the engine.

It is to be noted that the example embodiments and the example advantages as mentioned herein are generally described for a system when the position in the fluid medium passage downstream the valve at the point in time refers to a position in the exhaust passage at the point in time. However, it is also likely that the method can be performed when the position in the fluid medium passage downstream the valve is a position in the inlet passage. Therefore, the example advantages as mentioned herein are applicable both for a system when the position in a fluid medium passage downstream the valve at the point in time is a position in the exhaust passage at the point in time and when the position in the fluid medium passage downstream the valve is a position in the inlet passage.

In this context, the term "downstream", as used herein, refers to the direction of the flow of the fluid medium from the cylinder. Thus, the position in the fluid medium passage downstream the valve refers to a downstream point or position relative the location of the valve, as seen from the flow of fluid medium from the cylinder. By way of example, when the valve is an exhaust valve, the step of determining the differential pressure between the combustion cylinder and a position in a fluid medium downstream the valve at the point in time corresponds to the step of determining the differential pressure between the combustion cylinder and a position in the exhaust passage at the point in time.

Typically, the method is performed during operation of the vehicle. However, the method can be performed either in a standstill operation or in a driving operation. It may also be possible that the method in some installations is performed in a simulation environment etc.

Although it is possible to perform the method on a single cylinder, the method is normally performed on a number of cylinders in a sequence, as the vehicle often includes a number of cylinders. Typically, the method is adapted to operate at least once per cylinder with a number of conventional combustion cycles between each discrete cylinder pressure estimation of the engine. Thereby, the operation of the engine is allowed to stabilize to ensure that the engine can be operated in a stationary or steady-state mode during the step of monitoring the opening of the valve.

According to one example embodiment, the method is performed at least on a given combustion cylinder for a predetermined combustion cycle. By way of example, the predetermined combustion cycle is a conventional four-stroke combustion cycle.

It should be noted that although the method is typically intended for a diesel type engine, i.e. a diesel type combustion, the fuel provided for the combustion may in some example embodiments be provided for a premixed combustion, where the fuel may be injected directly into the cylinder or into an air upstream of the cylinder, e.g. by port injection. Further, it is to be noted that the method may also be used in an Otto-cycle engine, or a hybrid engine system of a diesel engine and an Otto-cycle engine.

The example embodiments of the method and the determined cylinder pressure, as mentioned above, can be used for several different purposes, such as:

adapting engine settings to current PCP limits;

estimating and adapting the engine to fuel properties;

estimating fluid medium recirculation, such as exhaust gas recirculation amount (EGR amount);

detecting cylinder-to-cylinder deviations;

comparing with a model predictive control (MPC) model.

Generally, the opening of the valve is performed by applying a known opening force on the valve, which is provided by the actuator. The required opening force for opening the valve depends on type of actuator and on various operational parameters such as pressure levels etc. However, the required opening force is normally predetermined and data indicative of the required opening force can be stored in the control unit etc. By way of example, the desired predetermined opening force is obtained by various predictions or from empirical data.

It is to be noted that the term "differential pressure", as used herein, typically refers to the differential pressure between the combustion cylinder and a position in a fluid medium passage at the point in time. That is, the term "differential pressure" refers to a difference between a gas pressure level of the fluid medium in the combustion cylinder and a pressure level of the combustion gas in the fluid medium passage, corresponding to fluid medium being directed away from the combustion cylinder.

The term "point in time", as used herein, typically refers to a point in time when counter-acting forces on the engine valve are essentially equal in magnitude. That is, the opening force on the engine valve is essentially equal in magnitude to the aggregate amount of the force from the combustion cylinder and the force from the fluid medium passage. The point in time is also a trigger point, as mentioned above, for the step of determining the cylinder pressure at the given point in time. The point in time may also be the starting point for estimating or determining other parameters such as the entire pressure trace, i.e. the cylinder pressure as a function of the crank angles degrees, which are further described below.

Moreover, it is to be noted that the determined cylinder pressure is normally an absolute cylinder pressure (ACP) value.

The wordings "top dead center" (TDC) and "bottom dead center" (BDC) are common terms used in the field of engine system comprising a reciprocating piston and should be construed as respective upper and lower end positions for the reciprocating motion of the piston within the combustion cylinder. When stating that a valve is opened and closed at one of the top dead center and bottom dead center, it should be realized that some tolerances are within the scope of the specific definition. For example, when stating that the inlet valve is opened, i.e. positioned in the open position when the piston reaches the top dead center, the inlet valve must not necessarily be opened at the exact top dead center position of the piston, but can be opened slightly before the piston reached the top dead center, or slightly after the piston has left the top dead center.

According to one example embodiment, the method further comprises the step of estimating cylinder pressure as a function of crank angle degrees of the reciprocating piston, as defined from the top dead center, based on the determined cylinder pressure at the point in time by modeling. In this manner, it becomes possible to estimate the cylinder pressure trace of a running internal combustion engine. In other words, the method is utilizing the determined cylinder pressure at the given point in time to determine the overall pressure trace, for example over an entire combustion cycle by performing a modelling of the variation of the cylinder pressure over a number of crank angle degrees.

Moreover, data derivable from the results of the estimated cylinder pressure as a function of the crank angle degrees can be used for balancing one or more of the combustion cylinders.

By way of example, the modelling in the above step refers to a model of an internal combustion cycle (process). The model should be configured to output a pressure trace of the cylinder of the engine.

Typically, the modeling in the step of estimating cylinder pressure as a function of crank angle degrees of the reciprocating piston, as defined from the top dead center, based on the determined cylinder pressure at the point in time is any one of a theoretical internal combustion model and an empirical internal combustion model. It is to be noted that there are several different types of internal combustion models, and the appropriate model is normally selected in view of type of engine and type of vehicle as well as in view of prevailing operational conditions.

According to one example embodiment, the method comprises the additional step of determining a peak cylinder pressure (PCP) from the estimated cylinder pressure as a function of the crank angle degrees. In this manner, it becomes possible to optimize the engine in view of prevailing PCP levels As mentioned above, the example embodiments allows for balancing one or more combustion cylinders based on the estimated cylinder pressure as a function of the crank angle degrees. According to one example embodiment, the method comprises the additional step of regulating the flow of fluid medium to one or a number of inlet valves based on the estimated cylinder pressure as a function of the crank angle degrees. Typically, the step of regulating the flow of fluid medium to the one or a number of inlet valves is performed by controlling the actuator of the flow control valve assembly based on the estimated cylinder pressure as a function of the crank angle degrees. Thereby, each one of the cylinders of the engine can be balanced relative each other in a simple and efficient manner.

It should be readily appreciated that balancing one or more combustion cylinders may also be based on the determined cylinder pressure at the point in time or based on part of the pressure cylinder trace.

Typically, although not strictly required, the step of monitoring the valve to determine a point in time when the valve opens may further comprise the step of sensing a position of the valve. The position of the valve can be detected in several different manners depending on type of engine, type of valve assembly and type of installation. In one example, the flow control valve assembly comprises a positioning sensor. In this example, the step of monitoring the valve to determine the point in time when the valve opens is performed by sensing the position of the valve by means of the positioning sensor. However, the sensor may be arranged in other locations in the internal combustion engine arrangement as long as it is possible to sense the position of the valve in a reliable manner. The positioning sensor is typically configured to detect and determine a position of a component such as a valve.

Typically, although not strictly required, the position in the fluid medium passage corresponds to a position in one of a fluid medium port or a fluid medium manifold.

According to one example embodiment, the method further comprises the step of determining a temperature in the fluid medium passage by a temperature sensor. In this manner, it becomes possible to take the temperature into consideration when determining the cylinder pressure. By measuring and determining the temperature in the fluid medium passage, the combustion model can be made even more accurate.

According to one example embodiment, the step of initiating an opening of the valve during the expansion stroke further comprises the step of activating the actuator to generate the opening force on the valve. In other words, the method is requesting or commanding the actuator to generate the opening force, which is typically performed by pressurizing the actuator with a compressed fluid medium, such as compressed air. However, the step of activating the actuator to generate the opening force on the valve can be performed in other ways depending on type of valve assembly.

According to one example embodiment, the step of initiating an opening of the valve during the expansion stroke is performed prior to the actuator being capable of opening the valve.

In addition, or alternatively, the step of initiating an opening of the valve during the expansion stroke is performed at a given crank angle degree of the reciprocating piston from the top dead center during the expansion stroke. Also, the step of initiating an opening of the valve during the expansion stroke generally comprises the step of delivering the opening force for opening the exhaust valve during a given number of crank angle degrees of the reciprocating piston from the top dead center during the expansion stroke.

It is to be noted that the valve is generally maintained in the open position until the steps of the method as mentioned above are performed. By way of example, the valve is maintained in the open position until the exhaust stroke is completed for the given cycle. Typically, although not strictly required, the valve is closed at the end of the exhaust stroke. Thus, according to one example embodiment, the method comprises the step of positioning the valve in the closed position at an exhaust stroke.

According to one example embodiment, the valve is an exhaust valve. In addition, or alternatively, the valve is an inlet valve. Thus, the valve is any one of an engine exhaust valve and engine inlet valve. It should thus be readily appreciated that the flow control valve assembly is any one of an exhaust flow control valve assembly and an inlet flow control valve assembly. It is also conceivable that the exhaust valve and the inlet valve are included in one common flow control valve assembly. Accordingly, the flow control valve assembly may comprise an exhaust valve, an inlet valve and the actuator configured to operate any one of the exhaust valve and the inlet valve. It may of course also be possible that the flow control valve assembly can comprise an exhaust valve and a corresponding exhaust valve actuator configured to operate the exhaust valve, and an inlet valve and a corresponding inlet valve actuator configured to operate the inlet valve.

As mentioned above, the flow control valve assembly comprises the actuator operatively connected to the valve. However, the flow control valve assembly can be provided in several different manners as long as it is operable to provide the opening force for opening the valve of the flow control valve assembly. To this end, the valve of the flow control valve assembly has an opening force being in proportion with the differential pressure acting on the valve. In addition, the actuator is configured to have a predetermined and limited opening force, i.e. an opening force which is possible to either estimate or predetermine in beforehand.

If the valve is an exhaust valve, the flow control valve assembly is an exhaust flow control valve assembly. Analogously, if the valve is an inlet valve, the flow control valve assembly is an inlet flow control valve assembly.

Independently of the type of valve assembly, the valve is operable between the open position and the closed position. In this manner, the flow control valve assembly is adapted to regulate the flow of a fluid medium passing through the flow control valve. The flow control valve assembly can be controlled in various manners.

In one example embodiment, the actuator is configured to operate the valve by means of pneumatic pressure. Accordingly, the actuator is a flow controllable actuator pneumatically operated by pressurized gas for opening and closing the exhaust valve. By way of example, the flow control valve assembly is a pneumatic flow control valve. As such, each valve has its own actuator controlling the valve position and timing. However, in other example embodiments, a number of valves may be controlled by common actuator.

An advantage with a pneumatically operated flow control valve assembly is that the valve can be rapidly controlled between the open and the closed position. Also, the valve may be operated independently of e.g. the rotation of a cam shaft.

According to an example embodiment, the step of providing the opening force for opening and closing the valve may comprise the step of providing pressurized fluid to said flow controllable actuator.

The actuator is typically configured to control the opening and closure of the valve at a given point in time. By way of example, the actuator is typically configured to control the opening and closure of the valve at a given point in time by receiving a signal from a control unit or the like.

In addition, or alternatively, the flow control valve assembly may be a lift valve member configured to regulate the height of the lift valve opening.

Typically, the internal combustion engine arrangement comprises one or a number of inlet valves. In particular, each one of the cylinders of the internal combustion engine has one or a number of inlet valves.

In addition, or alternatively, one of the inlet valves is a flow control valve assembly. Typically, each one of the inlet valves is a flow control valve assembly. In this manner, it becomes possible to operate an inlet valve in an efficient and fast manner resulting in an even more efficient engine arrangement.

Typically, the internal combustion engine arrangement comprises one or a number of exhaust valves. In particular, each one of the cylinders of the internal combustion engine has one or a number of exhaust valves. The method can be performed by any one of the exhaust valves for a given cylinder. However, the method is usually performed separately for each one of the exhaust valves, while the other exhaust valve(s) may be operated in a conventional manner.

In addition, or alternatively, one of the exhaust valves is a flow control valve assembly. Typically, each one of the exhaust valves is a flow control valve assembly. In this manner, it becomes possible to operate an exhaust valve in an efficient and fast manner resulting in an even more efficient engine arrangement.

Typically, although not strictly necessary, the method further comprises repeating some of the steps until the cylinder pressure is determined in an appropriate manner for a given point in time.

Typically, although not strictly required, the step of initiating the opening of the valve by the actuator during the expansion stroke is performed by controlling a valve parameter relating to any one of valve opening size, valve opening timing, valve opening duration, flow area, flow time, valve lift or a combination thereof.

The other valves of the groups of valves not being provided as flow control valve assemblies are typically check valves, non-return valves or the like. These types of valves may for instance be provided as conventional poppet type valves.

According to one example embodiment, when each valve in the group of valves is a flow control valve assembly, the method is configured to utilize each one of the valves in the group of the valve assemblies.

It is to be noted that the number of flow control valve assemblies, and the configuration of each valve and the configuration of the number of valves typically depends on the type of installation of the example embodiments, e.g. type of vehicle, type of engine etc.

It is also to be noted that the flow control valve assembly may be provided by another type of flow control valve assembly than the pneumatic flow control valve assembly. Thus, the flow control valve assembly may be any one of an electro-magnetic flow control valve assembly, a pneumatic flow control valve assembly, an electro-pneumatic flow control valve assembly, a hydraulic flow control valve assembly, an electro-hydraulic flow control valve assembly or the like.

As mentioned above, the step of initiating the opening of the valve by the actuator during the expansion stroke is performed by controlling the actuator operatively connected to a valve of the flow control valve assembly, the valve being adapted to regulate a valve opening upon a signal from the actuator. The valve is typically regulated to control the opening, closure, timing and flow area of the valve opening. The actuator is typically configured to control the opening and closure of the valve at the given point in time. By way of example, the actuator is typically configured to control the opening and closure of the valve at the given point in time by receiving a signal from a control unit or the like.

In some example embodiments, the intake stroke comprises the step of displacing the piston from the top dead center of the cylinder to the bottom dead center of the cylinder, while maintaining at least one inlet valve open during at least a part of the time the piston being displaced from the top dead center to the bottom dead center.

In some example embodiments, the step of performing the compression stroke of the cylinder is performed by displacing the piston from bottom dead center of the cylinder to top dead center of the cylinder.

According to one example embodiment, when the internal combustion engine arrangement comprises a number of combustion cylinders, each combustion cylinder being provided with a reciprocating piston movable within a corresponding combustion cylinder. In addition, there is provided at least one flow control valve assembly for each one of the combustion cylinders.

Typically, the method is performed to estimate the cylinder pressure during the expansion stroke. However, it may also be estimated at another time or stroke in the cycle of the engine. Moreover, the step of initiating an opening of the valve by the actuator is typically performed during at least a first half of the expansion stroke. However, it is also possible that the step of initiating an opening of the valve by the actuator may be performed at another part of the expansion stroke. Also, while the step of initiating the opening of the valve by the actuator is performed during the expansion stroke, some other steps of the method according to the example embodiments may be performed at another point in time, and during another part of the combustion cycle. By way of example, the data or information on the point in time when the valve opens in the expansion stroke can be used as input to the engine combustion model, as mentioned above, which can be performed at another point in time.

It is to be noted that the term "fluid medium", as used herein, is a working fluid medium and typically refers to a premixed working fluid medium that may contain air, fuel, burnt gases, other combustion particles and a mixture thereof. The fluid medium should be compressible and can be a compressed fluid medium, e.g. compressed air, compressed burnt gases and a mixture thereof.

It should also be noted that although the example embodiments of the method are generally based on using air as an incoming fluid medium in the combustion cylinder, the internal combustion engine system may in other configurations use a mixture of air and another gas, or only another type of gas or fuel. Also, in other design variants, the incoming fluid medium may be a liquid fluid medium, e.g. water, or an aerosol and the like. Thus, the example embodiments of the invention should not be regarded as limited to air as the incoming fluid medium.

According to one example embodiment, the method further comprises the step of determining a combustion start point by monitoring engine vibrations by a vibration sensor. In this manner, it becomes possible to take the combustion start point into consideration when determining the cylinder pressure, i.e. the vibration sensor is capable of detecting vibrations occurring from commerce of the combustion process. By measuring and determining the combustion start point by means of monitoring vibrations in the engine, the combustion model can be made even more accurate. In other words, the start point of the combustion process of the engine provides an additional reference point when determining the cylinder pressure in subsequent steps. The vibration sensor may e.g. be an accelerometer, a seismic sensor or the like. The vibration sensor should be able to detect vibrations, thereby permitting the sensor to monitor the combustion process. The vibration sensor can be arranged at several different locations in the engine arrangement, e.g. in a fuel injector or adjacent a fuel injection. Thus, in this example embodiment, the internal combustion engine arrangement comprises a vibration sensor configured to monitor vibrations from the engine.

In an example embodiment when the vibration sensor is arranged on the fuel injector, it is also possible to detect when the fuel injector is activated. Hereby, it becomes possible to detect the starting point of the process of injecting fuel into the cylinder chamber.

According to one example embodiment, the flow control valve assembly is an exhaust flow control valve assembly and the fluid medium passage is an exhaust passage.

According to one example embodiment, the flow control valve assembly is an inlet flow control valve assembly and the fluid medium passage is an inlet passage.

According to a second aspect of the present invention, there is provided an internal combustion engine arrangement which comprises a control unit for controlling the internal combustion engine arrangement. The control unit is configured to perform any one of the steps of the method according to any one of the example embodiments and/or the features as described above in relation to the first aspect of the present invention.

Effects and features of the second aspect are largely analogous to those described above in relation to the first aspect of the present invention.

It should be noted that the control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device. As mentioned above, the control unit may be a digital control unit; however, the control unit may also be an analog control unit. In addition, the control unit may be configured to control each one of the valves; in particular the control unit may be configured to control each one of the flow control valve assemblies of the system.

Typically, there is provided an internal combustion engine arrangement comprising a combustion cylinder housing a reciprocating piston movable between a bottom dead center and a top dead center within the combustion cylinder, and wherein the internal combustion engine arrangement further comprising the control unit connected to the flow controllable actuator and configured to control the flow controllable actuator to operate the flow control valve of the flow control valve assembly. That is, the control unit is configured to control the actuator to operate the flow control valve assembly.

According to a third aspect of the present invention, there is provided a vehicle comprising an internal combustion engine arrangement as described above in relation to the second aspect of the present invention. The engine can be e.g. a four-stroke internal diesel combustion engine. By way of example, the internal combustion engine system comprises a compression ignition internal combustion engine. The internal combustion engine may be e.g. a diesel engine, which as such may be running on several different types of fuel, such as diesel or dimethyl ether, DME. Other fuel types may also be conceivable, such as a renewable fuel as well as hybrid systems comprising an internal combustion engine and an electrical motor. As such, it should be readily appreciated that the example embodiments of the invention as described herein can be implemented in several different designs, both with respect to the engine as such, but also with respect to the cylinder design and the other components of the engine.

According to a fourth aspect of the present invention, there is provided a computer program comprising program code means for performing the steps described above in relation to the first aspect of the present invention when the program is run on a computer.

According to a fifth aspect of the present invention, there is provided a computer readable medium carrying a computer program comprising program means for performing the steps described above in relation to the first aspect of the present invention when the program means is run on a computer.

Effects and features of the third, fourth and fifth aspects are largely analogous to those described above in relation to the first aspect of the present invention.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein:

FIG. 1*b* also schematically illustrates an example embodiment of an operational step of the method according to the present invention, in which one of the valves is in an open state during an expansion stroke of the combustion cycle of the engine;

Figure 1A:
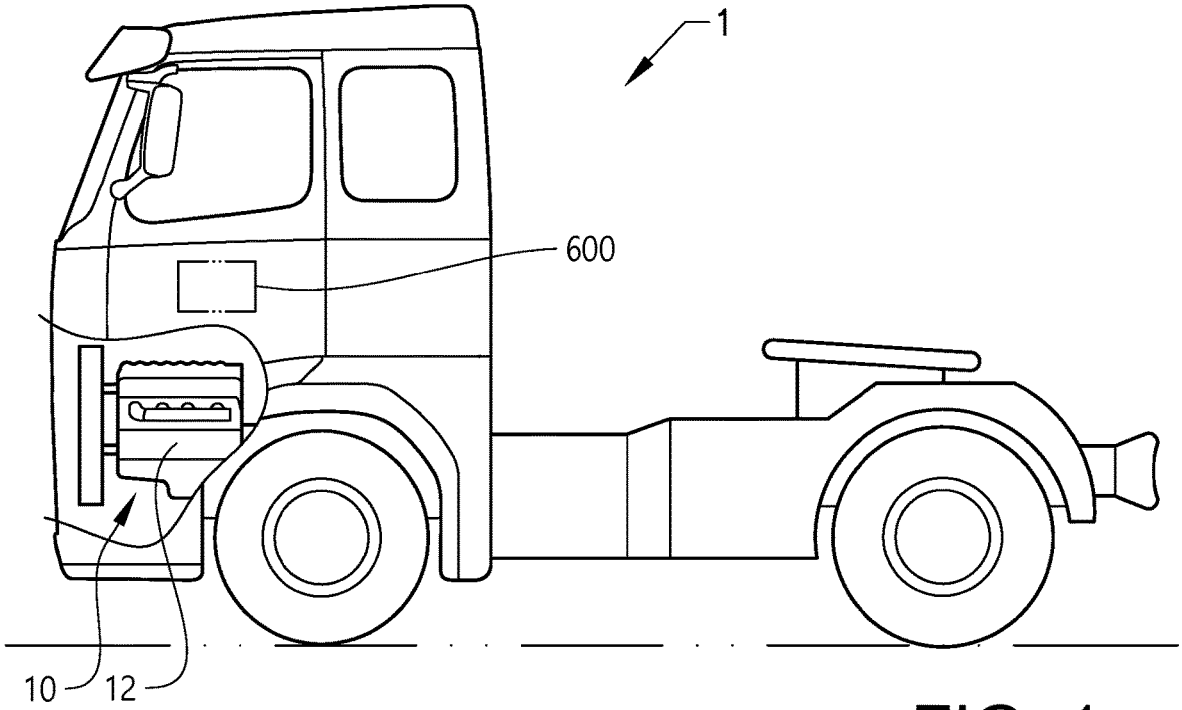
FIG. 1*a* is a side view of a vehicle in the form of a truck comprising an internal combustion engine arrangement adapted to be operated according to a method of an example embodiment of the present invention.

With reference to the appended drawings, below follows a more detailed description of embodiments of the invention cited as examples.

DETAILED DESCRIPTION OF EXAMPLE EMBODIMENTS OF THE INVENTION

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

FIG. 1*a* is a side view of a vehicle in the form of a truck, such as a heavy-duty truck, in particular a tractor for a semitrailer. The vehicle 1 in FIG. 1*a* comprises an internal combustion engine arrangement 10 adapted to be operated according to a method of an example embodiment of the present invention. The internal combustion engine 30 arrangement 10 comprises an internal combustion engine 12, as described below in more detail. The internal combustion engine 12 is generally operated in a four stroke fashion. In this example embodiment, the internal combustion engine is an internal diesel combustion engine, i.e. an engine designed to work according to the diesel process.

Figure 3A:
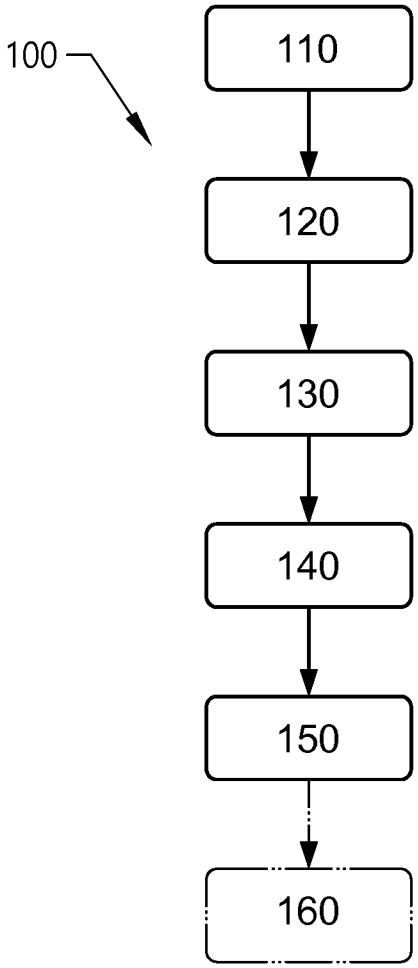
FIG. 3*a* is a block diagram depicting steps in a method according to an example embodiment of the present invention.
Figure 3B:
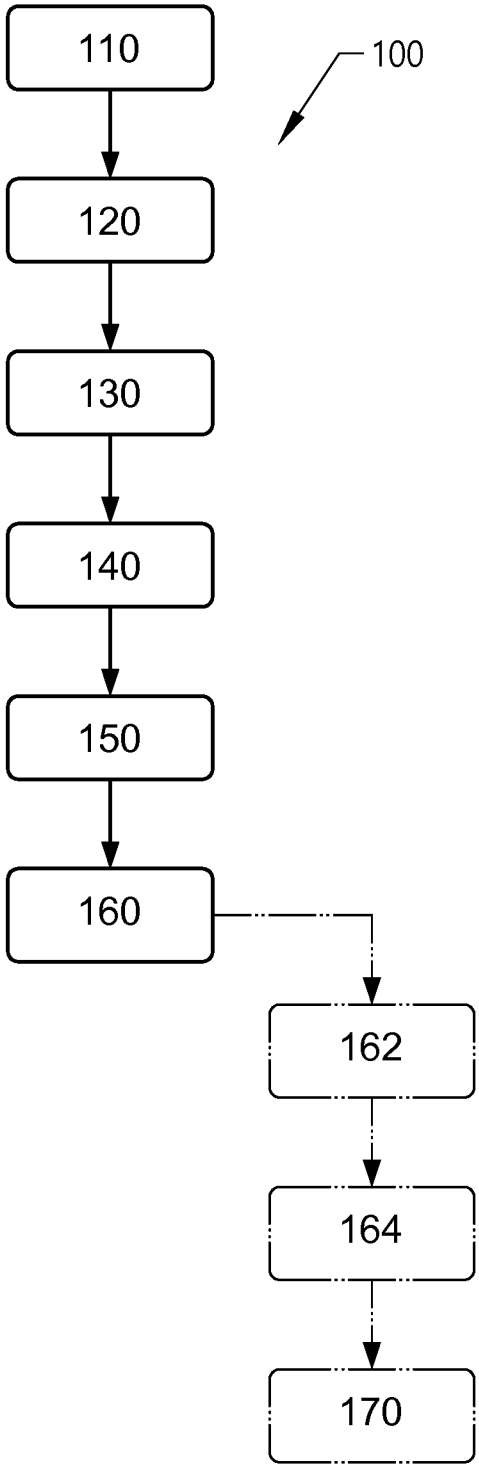
FIG. 3*b* is a block diagram depicting steps in a method according to another example embodiment of the present invention.

In addition, the internal combustion engine arrangement 10 comprises a control 35 unit 600 to perform the operational steps of the method according to the example embodiments as described herein, and which are further described in relation to FIGS. 3*a* and 3*b*.

Figure 1B:
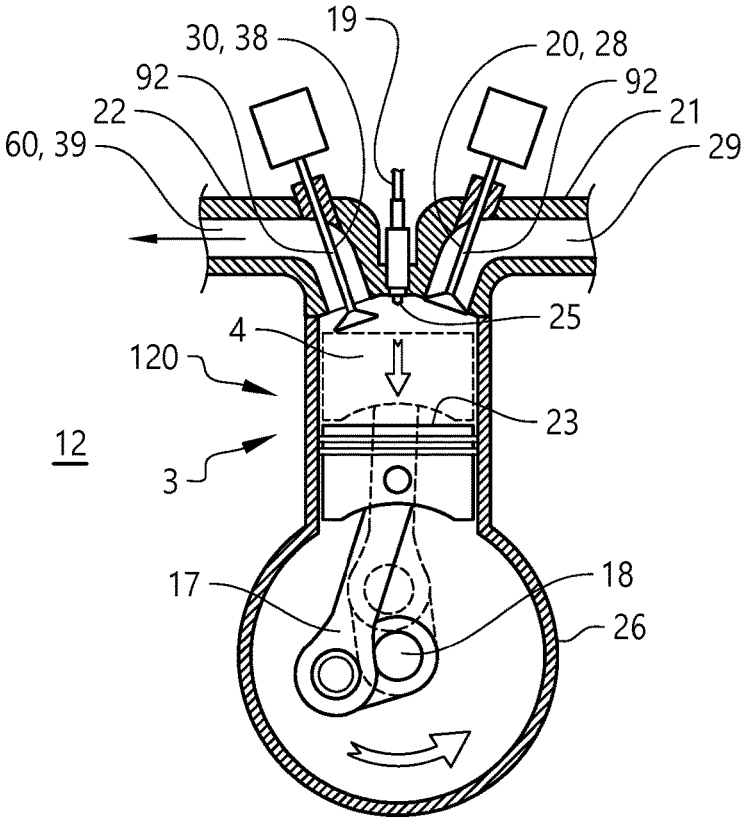
FIG. 1*b* is a schematic drawing of an internal combustion engine arrangement in the vehicle in FIG. 1, in which there is provided a cylinder comprising a combustion chamber and a reciprocating piston.

Turning now to the parts of the engine 12, FIG. 1*b* depicts one cylinder of the engine in the vehicle in FIG. 1*a*. As illustrated in FIG. 1*b*, the engine 12 generally comprises a cylinder 3 and a reciprocating piston member 23, which is often simply denoted as the piston 23. Typically, the internal combustion engine includes a plurality of cylinders, e.g. six to eight cylinders 3, each one having a corresponding piston 23.

The piston 23 is arranged to reciprocate between its uppermost position TDC, and its lowermost position BDC. In FIG. 1*b*, the piston 23 is located close to its BDC, while the piston position in FIG. 1*b* indicated by dashed lines illustrates the TDC position. The volume within the cylinder 3 between the BDC of the piston 23 and the cylinder top is generally referred to as a combustion chamber 4.

Each cylinder 3 of FIG. 1*b* comprises at its vertical top end at least one and typically a multiple number of inlet channels 21 for inlet air, and at least one and typically a multiple number of exhaust channels 22 for exhaust gases from the fuel combustion process taking place within the cylinder 3. The exhaust channel(s) typically interconnect(s) with an exhaust passage of an exhaust aftertreatment system. The engine also typically comprises a fuel injector for injecting fuel into a combustion chamber of the engine cylinder. Optional, although not shown, the fuel injector can comprise a vibration sensor configured to detect vibrations generated from combustion process. The vibration sensor can also be configured to detect when the fuel injector is activated and to transfer relevant information to the control unit for further processing.

Referring again to FIG. 1*b*, each inlet channel 21 has an inlet valve 20 for controlled inlet of incoming fluid medium, and each exhaust channel 22 has an exhaust valve 30 for controlled outlet of exhaust gases. In particular, the exhaust valve 30 is arranged to control fluid communication between the respective cylinder 3 and an exhaust port 39 of the exhaust channel 22 or the exhaust passage 60. Typically, the engine 12 comprises a number of exhaust valves 30 in fluid communication with the combustion chamber 4 and configured to regulate the evacuation of exhaust gases from the combustion chamber to the exhaust passage 60. As will be further described herein, at least one of the exhaust valves 30 is an exhaust flow control valve assembly 38 adapted to control the flow of a fluid medium passing through the exhaust flow control valve assembly. In this example embodiment, each one of the exhaust valves is provided in the form of an exhaust flow control valve assembly. The inlet valve 20 is arranged in fluid communication with the combustion chamber 4 and configured to regulate the supply of the incoming fluid medium to the combustion chamber 4. Generally, the engine comprises a number of inlet valves 20 in fluid communication with the combustion chamber 4 and configured to regulate the supply of the incoming fluid medium from an air inlet, which is part of an air inlet passage 29, to the combustion chamber 4. Typically, at least one of the inlet valves 20 is an inlet flow control valve assembly 28 adapted to control the flow of a fluid medium passing through the inlet flow control valve assembly. In this example embodiment, each one of the inlet valves is provided in the form of an inlet flow control valve assembly.

Figure 2:
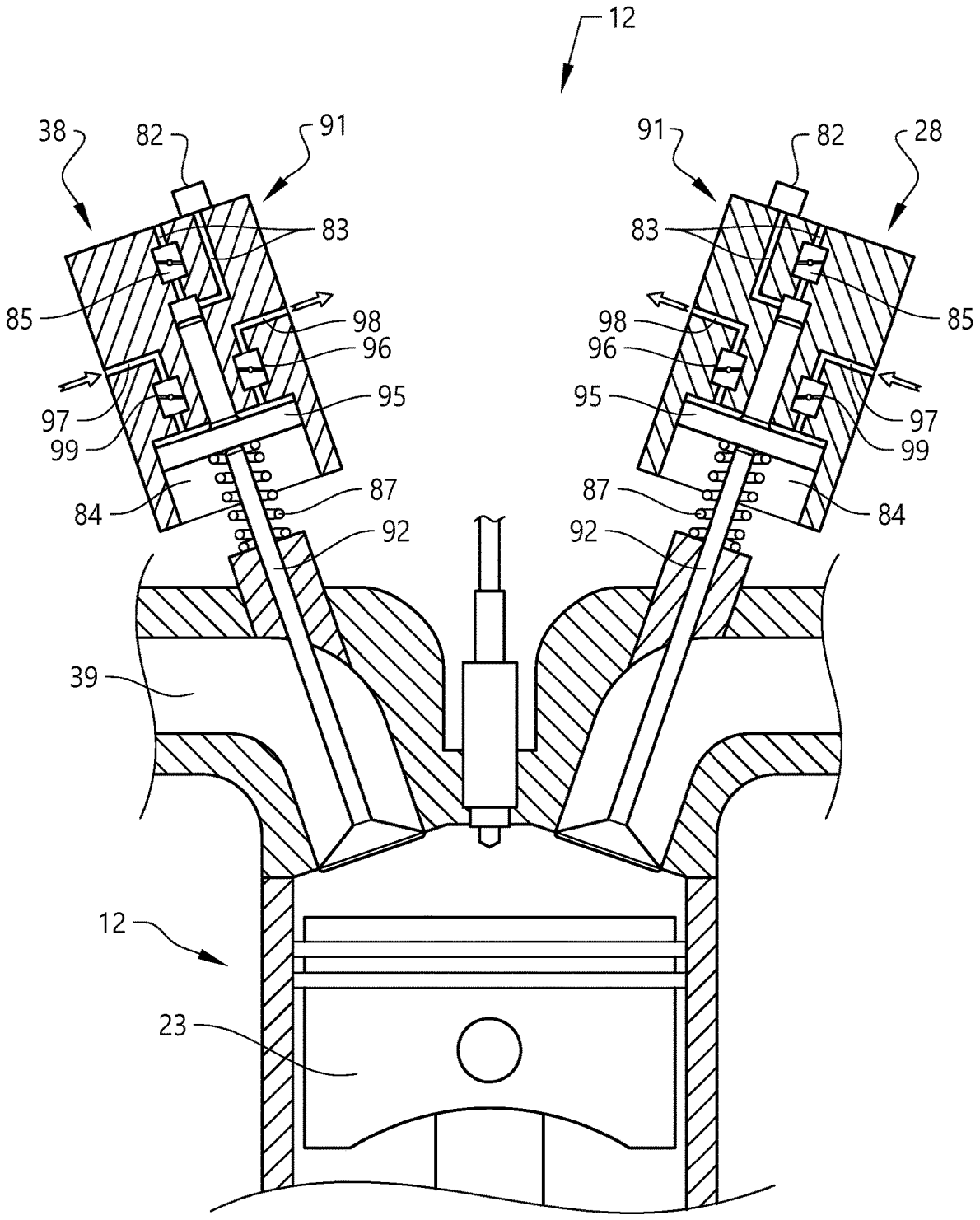
FIG. 2 schematically illustrates parts of an example of a flow control valve, which is intended for controlling a flow of a fluid medium in an internal combustion engine arrangement.

One example of a flow control valve assembly 28, 38 is shown in FIG. 2. This type of flow control valve assembly is one conceivable example embodiment of a flow control valve assembly intended for the system and the method as described herein in relation to the FIGS. 3*a* and 3*b*. The flow control valve assembly can be arranged as the inlet valve 20, thus denoted as the inlet flow control valve assembly 28 or as the exhaust valve 30, and thus denoted as the exhaust flow control valve assembly 38. In this example embodiment, and in the description in relation to FIG. 2, both inlet and exhaust flow control valve assemblies are of the same type, and the description is therefore applicable to both of them. The flow control valve assembly 28, 38 can be controlled in various manners. Typically, although not strictly necessary, the valve assembly 38 comprises an actuator 91 operatively connected to a valve 92 and configured to operate the valve by means of a pneumatic pressure. The actuator 91 is typically configured to control the opening and closure of the valve at a given point in time. By way of example, the actuator 91 is typically configured to control the opening and closure of the valve at a given point in time by receiving a signal from the control unit 600 or the like. Hence, in this example embodiment, the flow control valve assembly 28, 38 is a pneumatic flow control valve assembly. If the flow control valve assembly is a pneumatic flow control valve assembly, each one of the flow control valve assemblies 28, 38 is typically in fluid communication with a common air compressor (not shown), or a corresponding separate air compressor, being configured to supply compressed air to the corresponding flow control valve(s).

The valve 92 is here a lift type valve member. By way of example, the lift type member can be a conventional poppet valve or the like, as shown in FIGS. 1*b* and 2. The actuator 91 of the valve is configured to operate the valve 92 by pneumatic pressure. As such, the valve 92 is a pressure activated valve. In this example, each one of the flow control valve assemblies 28, 38 comprises a pneumatic actuator operatively connected to a corresponding valve.

In particular, as shown in FIG. 2, the actuator 91 of the valve assembly is configured to operate the valve via an actuator piston 95. The actuator 91 is in fluid communication with a pressurized air medium (not shown) via an air inlet 97 and an air outlet 98. In this manner, the pneumatic valve actuation utilizes compressed air to control the valve opening of the valve, i.e. to operate the valve between an open fluid medium state and a closed fluid medium state. Accordingly, the actuator 91 comprises at least the air inlet 97 for the pressure fluid medium and at least the air outlet 98 for the pressure fluid medium. The pressurized air flowing in via the air inlet 97 is directed towards the actuator piston 95 by a means of an air inlet valve 99. The air inlet valve 99 is disposed in the air inlet and configured to open and close the air inlet so as to control the flow of air to the actuator piston 95. Further, there is disposed an air outlet valve 96 in the air outlet 98, which is configured to open and close the air outlet in order to permit air to discharge from the actuator. Typically, as shown in FIG. 2, the actuator piston 95 is disposed in a chamber 84 defining a space for a reciprocating movement of the actuator piston 95. The actuator piston 95 is operable between a first position (an upper position), in which the valve 92 is in the closed state, and a second position (a lower position), in which the valve 92 is in the open state. In FIG. 2, the actuator is in the upper position, i.e. in the closed state. The actuator piston 95 is operable between the first position (upper position) and the second position (lower position) by pressurizing and depressurizing the actuator. In addition, the flow control valve comprises a spring 87 arranged in-between the valve 92 and the actuator piston disc 95 so as to return the valve to its original position, i.e. corresponding to the upper position of the actuator piston disc 95.

The flow control valve assembly 28, 38 may also have a hydraulic circuit 83 comprising a hydraulic circuit chamber. The purpose of the hydraulic circuit is to further control or dampening the movement of the actuator piston disc 95. The hydraulic circuit can be controlled by the hydraulic valve 85.

Moreover, the flow control valve assembly 28, 38 can include a control valve unit 82 to control the operation of the flow control valve assembly upon a signal from the control unit 600. By way of example, the actuator 91 is configured to operate upon the signal received from the control unit 600 to the control valve unit 82. The control valve unit may also include a sensor arrangement or the like to monitor the various components of the flow control valve assembly. Also, the control valve unit 82 is typically configured to control the various components of the flow control valve assembly, as mentioned above.

It should be readily appreciated that although the example embodiment above relates to a system in which each one of the inlet valves and each one of the exhaust valves is a flow control valve assembly, it may be sufficient that only one of the exhaust valves is a flow control valve assembly for performing the method as described in relation to FIG. 2.

Turning now to the operation of the engine, the engine according to one example embodiment is arranged to provide in each cylinder 3 a so called repeated four-stroke cycle. That is, the sequence of the operation of the engine per cylinder is based on the sequences of a conventional four stroke cycle. One example embodiment of the sequences of a method adapted to operate the engine according to the four stroke cycle includes the steps of performing the intake stroke, the compression stroke, the expansion stroke and the exhaust stroke.

FIG. 3*a* depicts one example embodiment of the sequences of a method according to the present t invention. The example embodiment of the sequences of the method can be performed on the vehicle internal combustion engine arrangement described in relation to FIGS. 1*a*-1*b* and 2. Hence, with reference to FIG. 3*a*, there is provided a method 100 for estimating a cylinder pressure CP in an internal combustion engine arrangement 10 of a vehicle 1, e.g. as described in relation to the FIGS. 1*a*-1*b* and 2. The internal combustion arrangement comprises the flow control valve assembly 28, 38 being in fluid communication with the combustion cylinder 3 and comprising the valve 92 operable between an open position and a closed position and the actuator 91 operable to provide an opening force for opening the valve.

As illustrated in FIG. 3*a*, the method comprises at least the following steps:

- initiating 110 an opening of the valve by the actuator during an expansion stroke;
- monitoring 120 the valve to determine a point in time Tp when the valve opens;
- determining 130 a differential pressure DP between the combustion cylinder and a position in the exhaust passage 60 at the point in time Tp;
- receiving 140 data being indicative of a pressure EP in the exhaust passage at the point in time Tp;
- determining 150 the cylinder pressure CP at the point in time Tp based on the determined differential pressure DP and the data indicative of the pressure in the exhaust passage.

The steps of the method according to the above, and also other steps described below, are performed during operation of the vehicle. Moreover, the method is generally performed either in a standstill operation or in a driving operation.

As mentioned above, the engine can be provided in several different configurations including one or more flow control valve assemblies. The flow control valve assemblies are particularly useful in step 110 so as to initiate the opening of the valve during the expansion stroke. In this example, the flow control valve assembly corresponds to the exhaust valve, i.e. the flow control valve assembly is an exhaust flow control valve assembly 38.

By way of example, the step 110 of initiating the opening of the valve during the expansion stroke further comprises the step of activating the actuator 91 to generate the opening force on the valve 92 (part of the exhaust flow control valve assembly 38). That is, in step 110, the method requests or commands the actuator to generate the opening force, which is typically performed by pressurizing the actuator with the compressed air. As such, the opening of the valve is performed by applying a known opening force on the valve, which is provided by the pressurized actuator. The required opening force for opening the valve depends on type of actuator and on various operational parameters such as pressure levels etc. In this example embodiment, the required opening force is predetermined and data indicative of the required opening force is stored in the control unit 600. The desired predetermined opening force is generally obtained from empirical data. Typically, the step of initiating 110 the opening of the valve during the expansion stroke is performed prior to the actuator being capable of opening the valve.

By way of example, the control unit 600 is configured to initiate the opening of the valve during the expansion stroke. For example, the step of initiating the opening of the valve by the actuator is typically performed during at least a first half of the expansion stroke. That is, the opening of the valve is performed early during the expansion stroke. However, it is also possible that the step 110 of initiating the opening of the valve during the expansion stroke is performed at a given crank angle degree of the reciprocating piston, from the top dead center during the expansion stroke.

Generally, the step 110 further comprises the step of delivering the opening force for opening the exhaust valve during a given subsequent number of crank angle degrees of the reciprocating piston, from the top dead center during the expansion stroke.

It should be ready appreciated that the exhaust valve opens at a point in time when counter-acting forces on the exhaust valve are essentially equal in magnitude. That is, the opening force on the exhaust valve is essentially equal in magnitude to the aggregate amount of the force from the combustion cylinder and the force from the exhaust passage. The forces acting on the exhaust valve can be derivable from the theory of equilibrium of forces in the combustion cylinder acting on the exhaust valve.

Similar to step 110, step 120 is also normally performed during the expansion stroke. One example of the position of the valve in step 120 is illustrated in FIG. 1*b*, in which the position of the valve 92 is illustrated immediately after opening while the piston performs the expansion stroke. The position of the valve 92 is in this example monitored by means of a sensor arranged in connection with the valve 92, e.g. in the exhaust flow control valve assembly 38. The sensor may for example be a positioning sensor configured to detect and determine the position of the valve. Thus, the step 120 of monitoring the valve to determine the point in time Tp when the valve 92 opens further comprises the step of sensing a position of the valve 92. By way of example, the exhaust flow control valve assembly comprises the sensor (not shown). The data or information indicative of the monitored position of the valve 92 can be temporarily stored in the control unit of the exhaust flow control valve assembly 38, which is described above. Moreover, data relating to the position of valve 92 is transferred from the exhaust flow control valve assembly 38 to the control unit 600 for further processing, e.g. in accordance with the subsequent steps 130, 140 and 150.

In the step 120, the opening of the valve 92 by the actuator 91 is performed by controlling the actuator 91 which is operatively connected to the valve 92. As the exhaust valve 92 is arranged in connection with the exhaust passage 60, i.e. the exhaust port 39 in e.g. FIG. 1*b*, an opening of the exhaust valve 92 generally implies that the passage between the combustion chamber 4 and the exhaust passage 60 opens in response to the operation of the actuator 91.

While the step 110 and the step 120 are performed during the expansion stroke, the steps 130, 140 and 150 can likewise be performed at another point in time. By way of example, the steps 130, 140 and 150 are performed subsequent the steps 110 and 120 and during the ongoing combustion cycles of the engine. Alternatively, the control unit 600 can gather and store the data from the step 120, and subsequently perform the steps 130, 140 and 150 at another point in time, and also at another location.

The exhaust valve 92 is generally maintained in the open position until the steps 110 and 120 of the method are performed. By way of example, the valve 92 is maintained in the open position at least until the exhaust stroke is completed for the given cycle. Typically, although not strictly required, the valve 92 is thus closed at the end of the exhaust stroke. Therefore, the method optionally comprises the step of positioning the valve 92 in the closed position at the exhaust stroke.

Subsequently, in step 130, the differential pressure DP is determined. The differential pressure is the difference between a gas pressure level of the fluid medium provided into the combustion cylinder and a pressure level of the combustion gas in the exhaust passage 60, which corresponds to the exhaust gas being directed away from the combustion cylinder. By way of example, the differential pressure can be determined by determining the force caused by the differential pressure between the combustion cylinder and a position in the exhaust passage 60 at the point in time Tp. When the force is determined, the differential pressure can be determined by disregarding the relatively small area difference between the upper face of the valve 92, i.e. the side of the valve facing the exhaust passage 60 (see FIG. 1*b*), and the bottom face of the valve 92, i.e. the side of the valve 92 facing the combustion chamber 4 of the cylinder 3 (see FIG. 1*b*). Alternatively, the differential pressure can be determined by measuring the pressure in the exhaust passage at the given point in time Tp. The pressure in the exhaust passage at the given point in time Tp can be determined as described in relation to step 140, see below.

It should be noted that the position in the exhaust passage 60 may either refer to the exhaust port 39 (see e.g. FIG. 1*b*) or the exhaust manifold (not shown). In this example, the step of determining the differential pressure is performed by determining the difference in pressure between the pressure in the combustion cylinder and the pressure in the exhaust port 39 (part of the exhaust passage 60), see e.g. FIG. 1*b*. The pressure at this position in the exhaust passage can be determined by a pressure sensor (not shown).

Turning now to the step 140 of receiving data indicative of the pressure EP in the exhaust passage at the point in time $T_p$, the position in the exhaust passage may analogously refer to the exhaust port or the exhaust manifold. In this example, the data in the step of receiving data indicative of the pressure EP in the exhaust passage at the point in time $T_p$ refers to data indicative of the pressure EP in the exhaust port 39, which is illustrated in e.g. FIG. 1*b*. Accordingly, the pressure EP is monitored at an appropriate position in the exhaust port. The pressure at this position in the exhaust port 39 can be determined by a pressure sensor (not shown). In other words, the pressure sensor is configured to measure a pressure in the exhaust port 39 (i.e. in the exhaust passage 60). The data or information indicative of the monitored pressure EP in the exhaust passage can be temporarily stored in an associated control unit, e.g. the control unit 600. As such, the step 140, as mentioned above, generally also comprises the step of determining the pressure EP in the exhaust passage based on the data indicative of the pressure in the exhaust passage. The pressure sensor is typically configured to transfer data indicative of the pressure EP in the exhaust passage to the control unit 600 for further processing, e.g. in accordance with the subsequent step 150.

Accordingly, in step 150, the cylinder pressure CP at the given point in time is determined based on the determined differential pressure DP and the data indicative of the pressure EP in the exhaust passage. As the differential pressure and the pressure in the exhaust passage are known from the steps 130 and 140, respectively, the cylinder pressure can be determined on the basis of a prevailing equilibrium of forces in the combustion cylinder at the given point in time Tp. That is, when there is equilibrium of forces, the counter-acting forces on the exhaust valve are essentially equal in magnitude.

Moreover, as illustrated in FIG. 3*a*, the method optionally comprises the step 160 of estimating cylinder pressure as a function of crank angle degrees of the reciprocating piston 23, as defined from the top dead center, based on the determined cylinder pressure CP at the point in time. Typically, the step 160 of estimating cylinder pressure as a function of crank angle degrees of the reciprocating piston 23, as defined from the top dead center, based on the determined cylinder pressure CP at the point in time is performed by modeling. The modeling in the step 160 is any one of a theoretical internal combustion model and an empirical internal combustion model. It is sufficient that the step 160 only estimates a part of the cylinder pressure trace in some implementations of the method according to the example embodiments. The type of model is typically selected in view of type of engine, type of vehicle and type of operational conditions.

By way of example, it becomes possible to determine the peak cylinder pressure (PCP) from the estimated cylinder pressure as a function of crank angle degrees. Thus, in another example embodiment of the method, as illustrated in FIG. 3*b*, the method additionally comprises the step 162 of determining the peak cylinder pressure from the estimated cylinder pressure as a function of the crank angle degrees.

In addition, the method in this example further comprises the step 170 of regulating the flow of fluid medium into the combustion cylinder by regulating the opening of one or a number of inlet valves based on the estimated cylinder pressure as a function of the crank angle degrees. By regulating the flow of fluid medium to one valve per cylinder, the method can be used for balancing the cylinders of the engine in a simple and efficient manner. Further, it may be even possible to regulate the flow of fluid medium to the valve immediately after step 130.

If the method is used on a number of cylinders, as mentioned above, the control unit can gather information from the number of the cylinders and estimate the cylinder pressure as a function of crank angle degrees for each one of the number of cylinders. By measuring on each one of the number of cylinders of the engine, it becomes possible to detect cylinder-to-cylinder deviation. Thereafter, the detected cylinder-to-cylinder deviation can be used as an input data to control the inlet valves to provide essentially equivalence cylinder pressure trace in each one of the cylinders of the engine.

Moreover, in order to further improve the accuracy of the cylinder pressure estimation, the method may take the temperature in the exhaust passage into consideration. Accordingly, as illustrated in FIG. 3*b*, the method comprises the step 164 of determining a temperature in the exhaust passage by a temperature sensor. Typically, data or information indicative of the monitored temperature in the exhaust passage can be temporarily stored in an associated control unit, e.g. the control unit 600. However, the temperature sensor is typically configured to transfer data indicative of the temperature in the exhaust passage to the control unit 600 for further processing in the step of estimating the cylinder pressure as a function of crank angle degrees.

It is even possible to take vibrations occurring from the combustion into consideration when determining the cylinder pressure as described above. By way of example, the method can further comprise the step of determining a combustion start point by monitoring engine vibrations by the vibration sensor, as mentioned above. The data or information indicative of the detected vibrations can be handled and processed in a similar manner as the data relating to the temperature, as mentioned above.

It is to be understood that the present invention is not limited to the embodiments described above and illustrated in the drawings; rather, the skilled person will recognize that many changes and modifications may be made within the scope of the appended claims. By way of example, although the steps of the example embodiments have been described in relation to an exhaust valve 30, the method may likewise be performed by using one of the inlet valves 20, or a combination of one engine inlet valve 20 and one engine exhaust valve 30.

The invention claimed is:

1. A method for estimating a cylinder pressure (CP) in an internal combustion engine arrangement, said internal combustion engine arrangement comprising an internal combustion engine having a combustion cylinder and a reciprocating piston movable within said combustion cylinder between a bottom dead center (BDC) and a top dead center (TDC), and further a flow control valve assembly adapted to regulate the flow of a fluid medium passing through the flow control valve in fluid communication with the combustion cylinder and comprising a valve operable between an open position and a closed position and an actuator operable to provide an opening force for opening the valve, characterized by the method comprising the steps of:

initiating an opening of said valve by said actuator during an expansion stroke;

monitoring said valve to determine a point in time (Tp) when said valve opens;

determining a differential pressure (DP) between a gas pressure level of the fluid medium in said combustion cylinder and a pressure level of the combustion gas in a fluid medium passage downstream said valve at said point in time (Tp);

receiving data being indicative of a pressure (EP) in said fluid medium passage at said point in time (Tp); and determining the cylinder pressure (CP) at said point in time (Tp) based on the determined differential pressure (DP) and said data indicative of the pressure in said fluid medium passage.

2. The method according to claim 1, further comprising the step of estimating cylinder pressure as a function of crank angle degrees (CAD) of the reciprocating piston, as defined from the top dead center, based on the determined cylinder pressure (CP) at said point in time by modeling.

3. The method according to claim 2, wherein said modeling in said step is any one of a theoretical internal combustion model and an empirical internal combustion model.

4. The method according to claim 2, wherein said method comprises the step of determining a peak cylinder pressure (PCP) from said estimated cylinder pressure as a function of the crank angle degrees.

5. The method according to claim 2, further comprising the step of regulating the flow of fluid medium to an inlet valve based on said estimated cylinder pressure as a function of the crank angle degrees.

6. The method according to claim 1, wherein said step of monitoring said valve to determine a point in time (Tp) when said valve opens further comprises the step of sensing a position of the valve.

7. The method according to claim 6, wherein the flow control valve assembly comprises a positioning sensor, and said step of monitoring said valve to determine a point in time when said valve opens is performed by sensing the position of the valve by means of said positioning sensor.

8. The method according to claim 1, wherein said position in the fluid medium passage corresponds to a position in one of a fluid medium port or a fluid medium manifold.

9. The method according to claim 1, further comprising the step of determining a temperature in said fluid medium passage by a temperature sensor.

10. The method according to claim 1, wherein the step of initiating an opening of the valve during the expansion stroke further comprises the step of activating the actuator to generate the opening force on the valve.

11. The method according to claim 1, wherein the step of initiating an opening of the valve during the expansion stroke is performed prior to the actuator being capable of delivering the opening force for opening the valve.

12. The method according to claim 1, wherein the step of initiating an opening of the valve during the expansion stroke is performed at a given crank angle degree of the reciprocating piston from the top dead center during the expansion stroke.

13. The method according to claim 1, further comprising the step of determining a combustion start point by monitoring engine vibrations by a vibration sensor.

14. The method according to claim 1, wherein said flow control valve assembly is an exhaust flow control valve assembly and said fluid medium passage is an exhaust passage.

15. The method according to claim 1, wherein said flow control valve assembly is an inlet flow control valve assembly and said fluid medium passage is an inlet passage.

16. An internal combustion engine arrangement comprising a control unit for controlling said internal combustion engine arrangement, characterized in that the control unit is configured to perform any one of the steps of the method according to claim 1.

17. A vehicle comprising an internal combustion engine arrangement according to claim 16.

18. A computer program comprising program code means for performing the steps of claim 1 when said program is run on a computer.

19. A computer readable medium carrying a computer program comprising program means for performing the steps of claim 1 when said program means is run on a computer.

* * * * *